US005277109A

United States Patent [19]

Muench

[11] Patent Number: 5,277,109

[45] Date of Patent: Jan. 11, 1994

[54] SANITARY LIQUID/SOLID SEPARATOR

[75] Inventor: Charles A. Muench, Ballwin, Mo.

[73] Assignee: Custom Metalcraft, Inc., Springfield, Mo.

[21] Appl. No.: 940,343

[22] Filed: Sep. 3, 1992

[51] Int. Cl.[5] ..... B30B 9/06

[52] U.S. Cl. ..... 100/112; 99/408; 100/116; 100/131; 100/218; 100/245; 100/250; 210/196; 210/359; 210/DIG. 8; 220/333

[58] Field of Search ..... 100/104, 110, 112, 116, 100/131, 218, 245, 250; 99/408; 210/167, 196, 359, DIG. 8; 220/333, 260

[56] References Cited

U.S. PATENT DOCUMENTS

| | | | |
|---|---|---|---|
| Re. 13,351 | 1/1912 | Alvord | 100/218 X |
| 701,882 | 6/1902 | Holden | 100/250 X |
| 1,071,020 | 8/1913 | Bartholomew | 100/116 |
| 1,097,157 | 5/1914 | Alvord | 100/116 X |
| 1,110,283 | 9/1914 | Beaston | 100/116 |
| 1,602,626 | 10/1926 | Power | 100/112 |
| 1,705,908 | 3/1929 | De Witt | 210/359 X |
| 2,584,500 | 2/1952 | Riordan | 220/333 X |
| 2,639,144 | 5/1953 | Long | 220/333 X |
| 2,705,916 | 4/1955 | Millgard | 100/116 X |
| 3,055,290 | 9/1962 | Arvanitakis | 100/116 |
| 3,488,883 | 1/1970 | Clements et al. | 220/333 X |
| 3,550,775 | 12/1970 | Cooley | 100/112 X |
| 3,565,297 | 2/1971 | Bladt et al. | 100/218 X |
| 3,948,163 | 4/1976 | Ligh | 100/250 X |
| 4,230,733 | 10/1980 | Tilby | 100/116 X |
| 4,387,633 | 6/1983 | Ballantyne | 100/116 X |
| 4,467,715 | 8/1984 | Bunger | 100/116 X |
| 4,566,375 | 1/1986 | van der Schoot | 220/333 X |
| 5,146,848 | 9/1992 | Dufour | 100/112 X |

FOREIGN PATENT DOCUMENTS

| | | | |
|---|---|---|---|
| 2129328 | 5/1984 | United Kingdom | 100/110 |

*Primary Examiner*—Stephen F. Gerrity
*Attorney, Agent, or Firm*—Jerome A. Gross

[57] ABSTRACT

This invention is particularly useful in food processing for separating crumbs and particles of breading material which have become suspended in frying oil, so that the oil may be reused. Separation is done in a unique cylinder having a hollow piston, whose forward end has a screen and whose aft face is imperforate. The cylinder has an openable door at its forward end. Near its end door the cylinder has a liquid inlet and a liquid outlet spaced somewhat aft therefrom. When the piston is in its retracted position its screen end is positioned axially between the inlet and outlet, so that the liquid may pass through the screen. Air pressure in the portion of the cylinder aft of the piston acts against its imperforate face to drive it forward. The screen end of the piston filters and drives the liquid back to the outlet, solids are compacted against the door. When the door is opened, compressed air introduced into the piston discharges the compacted particles as a cake out of the cylinder's open end and cleans the screen.

17 Claims, 7 Drawing Sheets

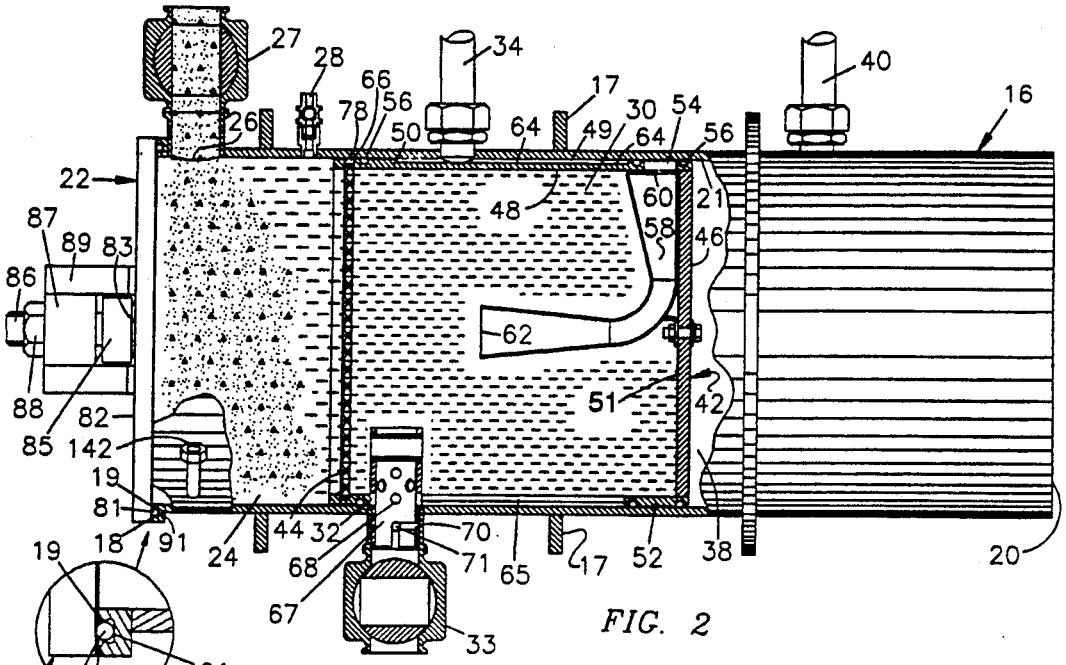
FIG. 2
FIG. 2a
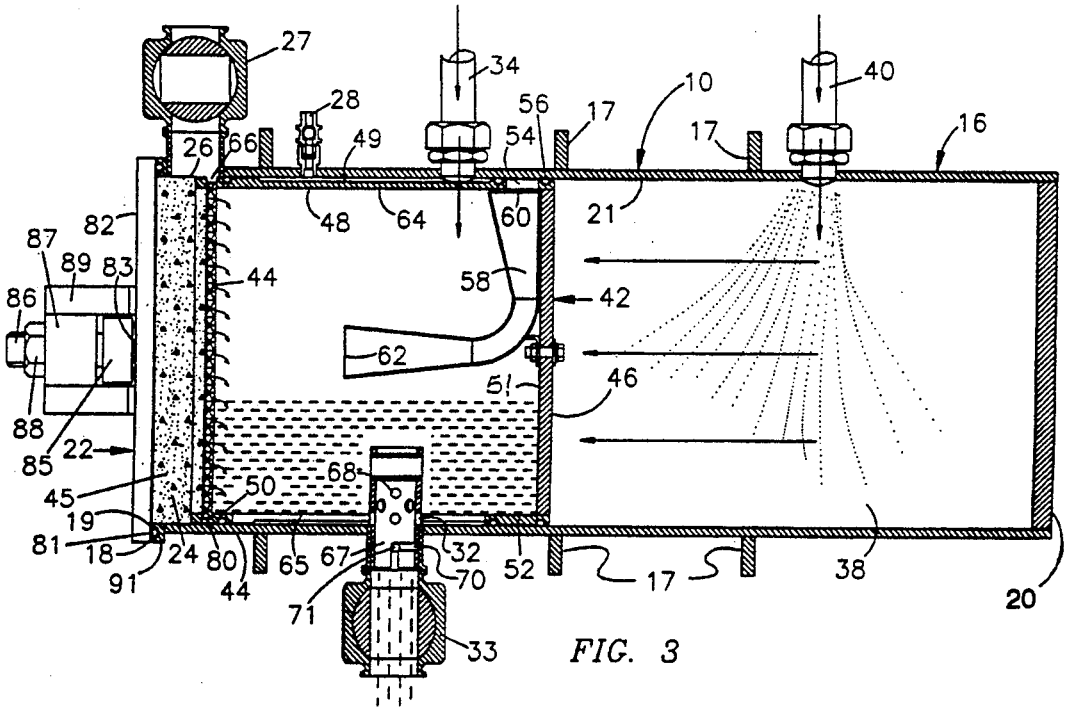
FIG. 3

FIG. 11. OPERATIONAL SEQUENCE
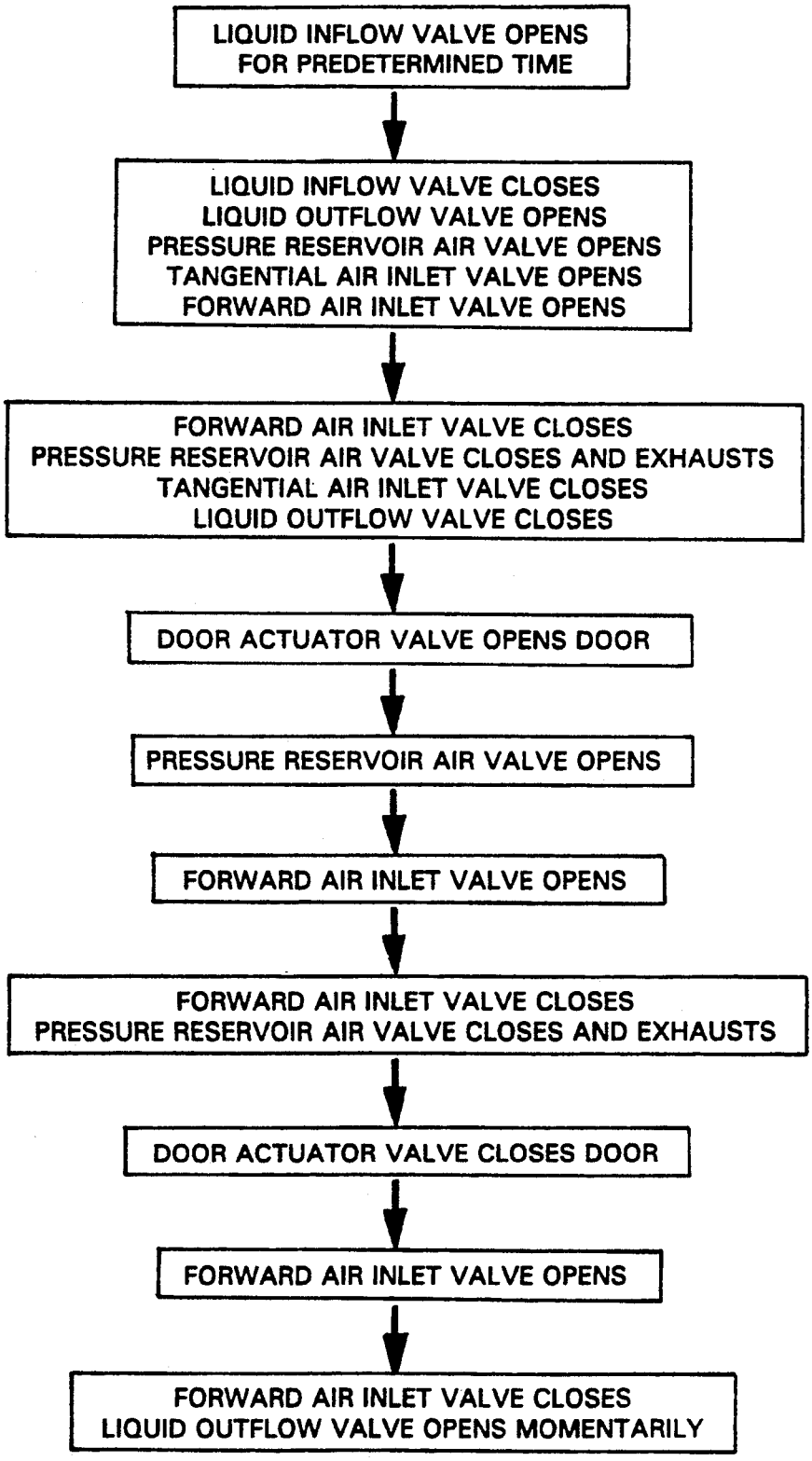

SANITARY LIQUID/SOLID SEPARATOR

FIELD OF THE INVENTION

The present invention of a sanitary liquid/solid separator is particularly useful in food processing for separating crumbs and particles of breading material which have become suspended in frying oil, so that the oil may be re-used. More generally it relates to separating liquids from solids, for salvaging either the liquid, the solids therein suspended, or both simultaneously, and to allow separate handling for re-use or disposal of either the solids or liquid or both.

DESCRIPTION OF RELATED ART

For specialized use in waste disposal, not for use in food processing, two mechanisms are known which employ compression and compaction to remove solids. U.S. Pat. No. 4,387,633, to Ballentyne, for removing solids from waste sludge teaches compaction in a cylinder against its end door, which opens by angular movement to displace lugs on the door from lugs on the cylinder end. This construction also utilizes repeated piston strokes to drive out liquid newly admitted during each retraction of the piston. U.S. Pat. No. 4,343,233 to Burgin illustrates compression of solids between two piston faces. Neither provides for cleaning of a filter after compaction strokes of the piston. Neither of these inventions is adapted for clarifying frying oils.

Use of a separation process is especially important in the fried foods process.

For large volume factory frying of foods, clarifying and re-using the frying oil is a practical necessity. Removal of suspended solids from frying oil enhances the appearance and improves the flavor of foods cooked in such oil.

Apparatus currently used to clarify frying oil differ markedly from the current invention:

U.S. Pat. No. 4,081,375, to Deal, teaches the use of a continuous belt of fine mesh through which oil is allowed to pass; U.S. Pat. No. 4,517,082 to Prudhomme illustrates a dual filter system composed of a screen filter and a filter canister; U.S. Pat. No. 4,787,972 to Stubblebine uses a continuous filter belt having a coarse filter stage and a fine filter stage; U.S. Pat. No. 4,826,590 to Turman also teaches the use of a two-stage filter system; and U.S. Pat. No. 4,622,135, to Williams, shows a one-stage filter unit designed to return oil more quickly to the cooker. None of these mechanisms utilize the exertion of pressure to compact the solids and separate them from the liquid oil.

SUMMARY OF THE INVENTION

In the present invention separation is done in a unique cylinder having a hollow piston, whose forward end has a screen and whose aft face is imperforate. The cylinder has an end door openable to eject the solids compacted by the screened piston.

Near its end door the cylinder has an oil inlet; spaced somewhat aft therefrom is an oil outlet. When the piston is in retracted position its screen end is positioned axially between the inlet and outlet, so that the frying oil may pass through the screen. Air pressure in the portion of the cylinder aft of the piston acts against its imperforate face to drive it forward. The screen end of the piston filters and drives oil back to the outlet, while crumbs and other solids are compacted against the door. When the door is opened, compressed air introduced into the piston discharges the compacted particles as a cake out of the cylinder's open end and cleans the screen. A more detailed statement of operation is set forth hereafter.

BRIEF DESCRIPTION OF THE DRAWINGS

FIG. 2 is a vertical cross-section along the axis of the cylinder of a liquid-solid separator embodying the present invention, with its piston in retracted position.

FIG. 2*a* is an enlarged view of a partial cutaway of the forward edge of the open end of the cylinder showing a dovetail cut groove and an O-ring seal.

FIG. 3 is a vertical cross-section similar to FIG. 2 showing the piston in its compacting stroke position.

FIG. 9-*b* shows the same assembly with the door in closed position, but partly broken away to show the piston screen.

FIG. 11 is a chart illustrating and summarizing the operational sequence of the present liquid/solid separator.

DESCRIPTION OF THE PREFERRED EMBODIMENT

Figure 1:
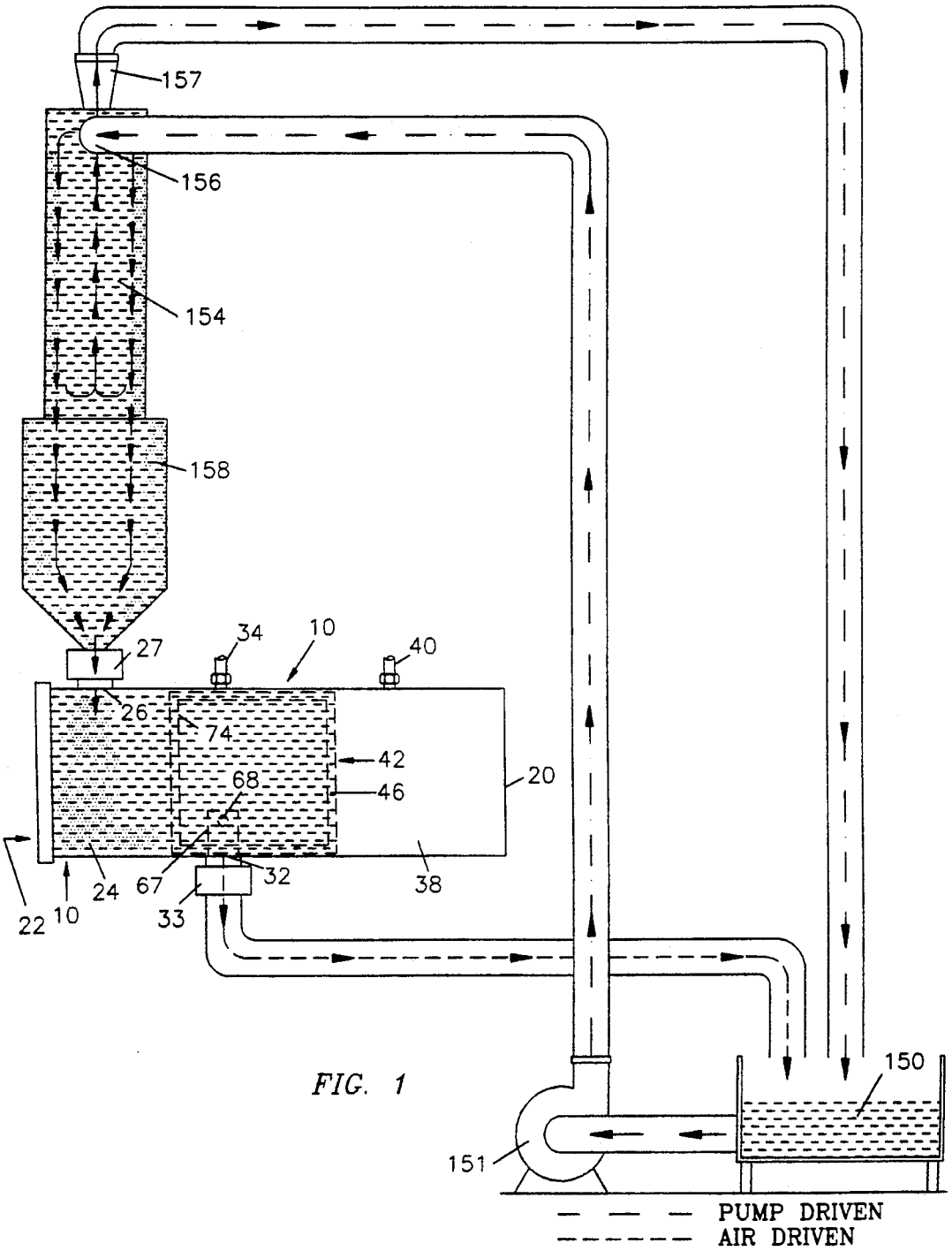
FIG. 1 is a diagram of the principal elements of a system incorporating the present invention, with dotted arrows distinguishing that portion of the liquid flow which is pump driven from the undotted arrows which illustrate flow which is returned to a vat by air pressure.

The liquid/solid separator generally designated 10, shown in FIGS. 1–9, comprises a hollow, constant diameter cylinder generally designated 16, reinforced at intervals by outstanding ribs 17 and having a forward open end 18 closable by a cylinder door 22 hereafter described, and terminating in a closed end 20. The cylinder 16 may be considered to consist of three sections:

1. A compacting stroke section 24, inward of the open end 18, contains, axially adjacent thereto, a liquid inflow means 26 including a liquid inflow ball valve 27 and, adjacent thereto, a pressure relief valve 28 which closes responsive to a small pressure increase within the cylinder 16.

2. A piston retracted section 30, inwardly from the compacting stroke section 24, containing a bottom outflow port 32 including an outflow ball valve 33 and, spaced slightly aft therefrom, a top forward air inlet 34; and 3. A pressure reservoir section 38, farther inward, which terminates in the closed cylinder end 20, and contains a port 40 for pressurized air.

A hollow piston, generally designated 42, is shown in FIG. 2 fitted slidably within the inner wall 21 of the cylinder 16, in its piston-retracted position shown in solid lines. The piston 42 has a screen-like front wall 44 hereinafter described, and an imperforate rear wall 46. The piston sides are numbered as an interior side 48 and an exterior side 49.

Sliding contact with the inner wall 21 of the cylinder 16 is made by front and rear larger diameter piston portions 50, 52. The rear portion 52 contains, adjacent to the piston rear wall interior side 51, a piston top air inlet 54, and two rear groove-accommodated O-rings 56, which flank the air inlet 54. An airhorn 58 made of stainless steel tubing and having a 90° elbow is bolted to the rear wall 46 so that the airhorn inlet 60 is aligned with the piston top air inlet 54, and the airhorn outlet 62 is located in the center of the piston facing front wall 44. Use of the airhorn 58 results in a uniform gust of air against the front wall 44. The front larger diameter portion 50 contains, behind the piston screen-like front wall 44, a single groove-accommodated O-ring 56.

The piston 42 has a smaller diameter cylindrical side wall 64 which extends between and connects the front and rear larger diameter piston portions 50, 52. This smaller diameter side wall 64 has a forward-and-aft bottom flow slot 65 into the interior of the piston 42.

The piston screen-like front wall 44 is preferably a sintered stainless steel screen, and preferably capable of filtering particles five microns or larger. It is mounted within a ring-like frame 66 of a slightly smaller diameter than that of the piston 42, the frame 66 fitting slidably through a slot 78 and into a groove 80 located within the piston front larger diameter portion 50, forward of the O-ring 56.

The travel of piston 42 is limited by a standpipe 67 which extends from bottom outflow port 32 through slot 65. Further, the standpipe 67 prevents piston 42 from rotating within cylinder 16. Perforations 68 in the standpipe 67 facilitate draining of the liquid from the piston 42. The standpipe 67 may be held in place by a bayonet fitting 70 with a rod 71 welded to outflow port 32.

In the preferred embodiment, the forward edge 19 of the cylinder 16 contains a dovetail cut groove 91 fitted with an O-ring seal 81, as shown in FIG. 2*a*.

Figure 6:
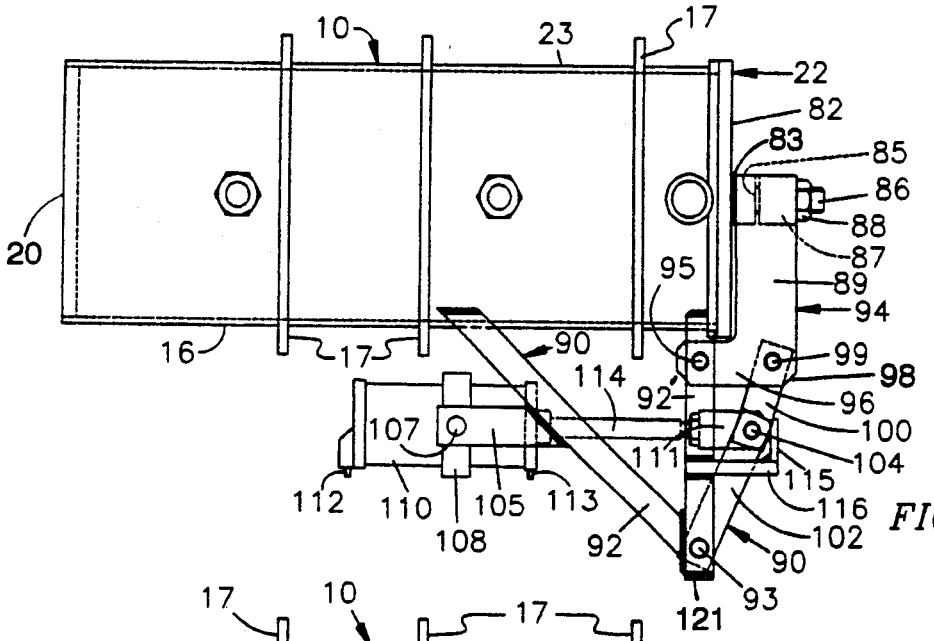
FIG. 6 is a top view of the cylinder of FIGS. 2–5 of the cylinder door closed and the door linkage mechanism in corresponding position.
Figure 9A:
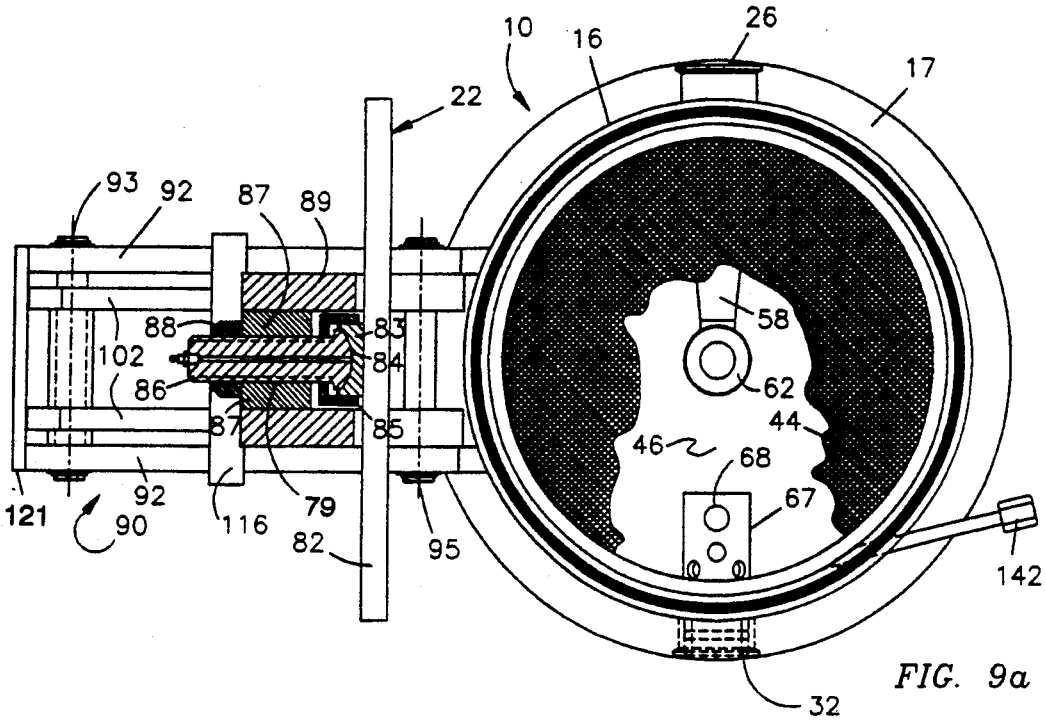
FIG. 9-*a* is a partial front view of the open cylinder door and door linkage mechanism, seen in FIG. 7. The door mounting is shown in cross-section, and the piston front screen is partially broken away to show the standpipe and air horn extending into the piston interior.
Figure 9B:
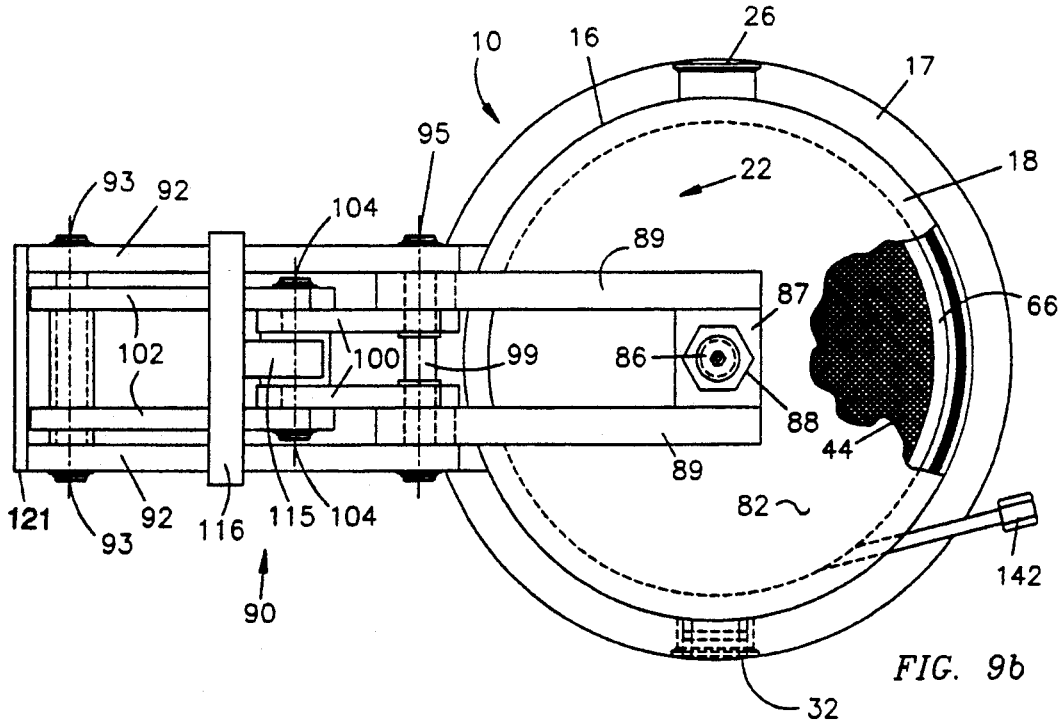

A heavy disk-like door generally designated 22, and shown in FIGS. 6. 7. 9-*a* and 9-*b*. is provided at the cylinder open end 18 to sealedly close the cylinder 16. As seen in FIG. 9-*a*, onto the center of the door outer face 82 is welded a threaded attachment fitting 83; the fitting includes a concave spherical cavity 84. Threaded onto fitting 83 is a threaded collar 85 which surrounds the shaft of a convex-headed bolt 86, whose head is loosely trapped within the concave cavity 84, providing for tilting fit around a mounting point center. As shown in FIG. 9-*a* only, the bolt 86 may be hollow, and provided at its outer end only with a conventional grease fitting, not numbered. A mounting block 87, having a threaded central bore 79 through which the threaded shaft of the bolt 86 extends, is locked in place by a hex nut 88. To upper and lower faces of the mounting block 87 are welded the terminate ends of the bell crank upper and lower longer arms 89.

A clevis-type door operating bracket generally designated 90, comprising upper and lower diagonal members 92 welded at their inner ends to the cylinder outer wall 23 and at their outer ends to forward upper and lower members 92' outstanding from the cylinder forward end 18. The upper and lower brackets 92, 92' are joined at their outstanding ends by a vertical welded connector bar 121, by a farther bracket linking pin 93. The connector bar 121 is shown in FIGS. 9-*a* and 9-*b*, but for clarity, omitted from FIG. 8.

Upper and lower right angle bell cranks generally designated 94 are pivotally attached as shown in FIG. 6, to a nearer linking pin 95 by their shorter arms 96, the length of which is sufficient to extend past the cylinder open end 18. The bell crank upper and lower longer arms 89 terminate at and are welded to the upper and lower surfaces of the bolt mounting block 87.

At the angled intersections 98 of the bell crank upper and lower arms is a bell crank center pin 99. When the door is closed as shown in FIG. 6, the bell crank center pin 99 is directly forward of the nearer linking pin 95, and the length between the bell crank center pin 99 and the farther linking pin 93 is taken up by the linear alignment with each other of a shorter actuator link 100 and a longer actuator link 102 joined together by a clevis pin 104.

The lengths of the clevis pin 104 and the bell crank center pin 99 must be such that they may pass between the clevis bracket upper and lower triangulated arms 92 during operation. The clevis pin 104, the bell crank center pin 99, and the linking pins 93, 95 are held by conventional snap rings, not numbered.

Figure 8:
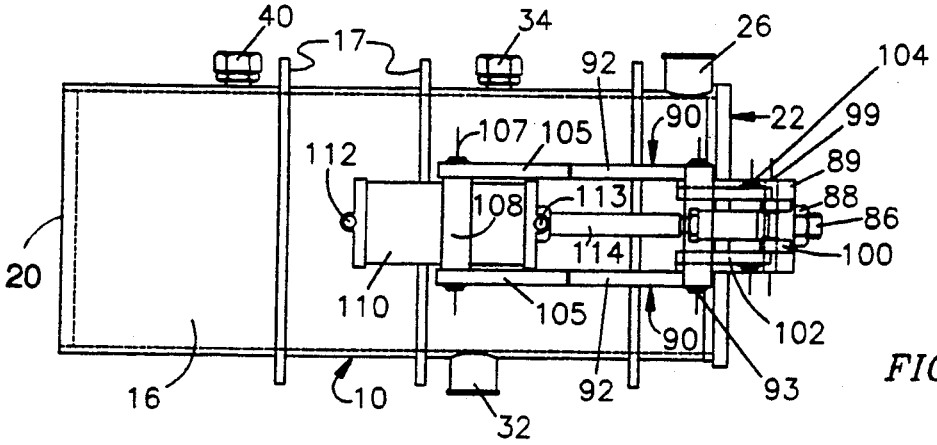
FIG. 8 is a side view thereof showing the door linkage mechanism in the door closed position, with the safety stop and connector bar removed.

As illustrated in FIG. 8, welded on the upper and lower outer surfaces of the triangulated brackets 92 are aft extending support bars 105 in which are mounted, to enable angular movement, the trunions 107 of a trunion block 108. The trunion block 108 mounts a pneumatic actuator 110 having a thrust port 112 and a retraction port 113. A linear actuator 114 having a clevised end 111 extends forwardly with its end mounted about the clevis pin 104 which drives the upper and lower short links 100 and the upper and lower long links 102. The length of the pin 104 is less than the spacing between the clevis bracket upper and lower arms 92.

Figure 7:
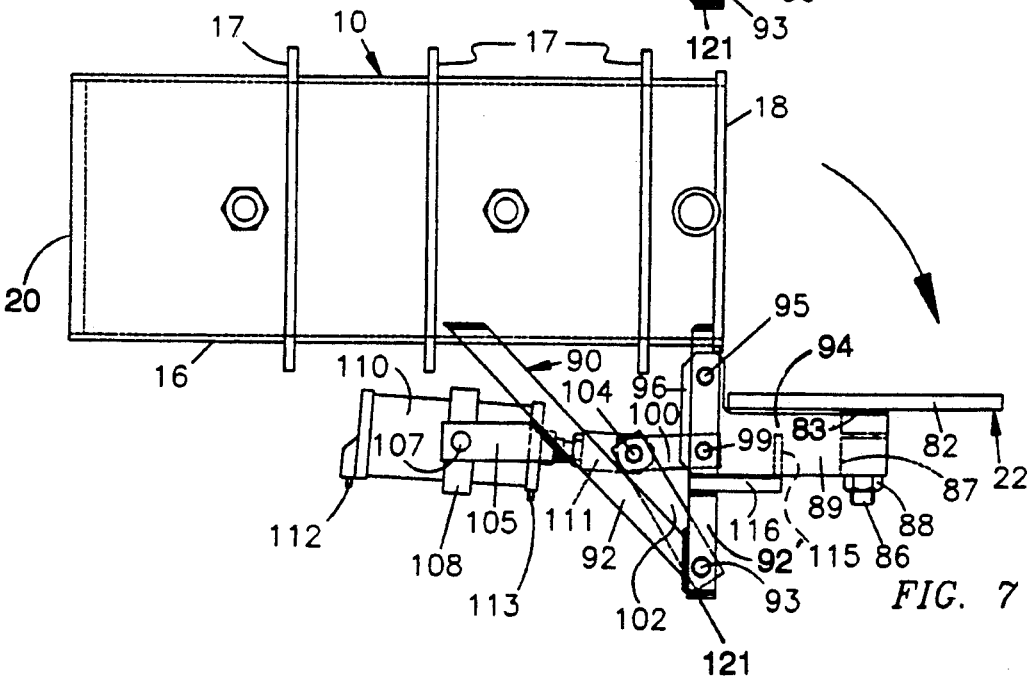
FIG. 7 is a top view thereof showing the door linkage mechanism in the door-open position.

Operation of the door, starting with the door 22 in the closed position, as shown in FIG. 6, will now be described. Application of pressurized air to the retraction port 113 of the pneumatic door-actuator 110, retracts the linear actuator rod 114, drawing the clevis pin 104 generally aft, the trunions 107 permitting the actuator 110 to adjust its angular position as the shorter and longer links 100, 102 are drawn out of alignment and aft, between the clevis bracket upper and lower members 92, 92' to the position shown in FIG. 7. Such retracting movement of the linear actuating rod 114 swings the upper and lower bell cranks 94 about the nearer linking pin 95, the longer bell crank arms 89 being rotated 90° to withdraw the door 22 outward and around as shown in FIG. 7. Thus, the door 22 is drawn completely sideward of the cylinder 16.

On door closing, the air pressure supply to the thrust port 112 reverses the linear movement of the rod 114, swinging the bell crank shorter arms 96 around the nearer linking pin 95 to set the door 22 firmly in closed position. It is noted that the final forward movement of the linear actuating rod 114, which places the links 100, 102 into linear alignment, exerts a strong thrust force on the door, but with little final angular movement as the actuating rod 114 reaches its full forward position of 1/32" past linear alignment. Further forward movement of actuating rod 114 is restricted at the front face 115 of a stop 116.

Figure 10:
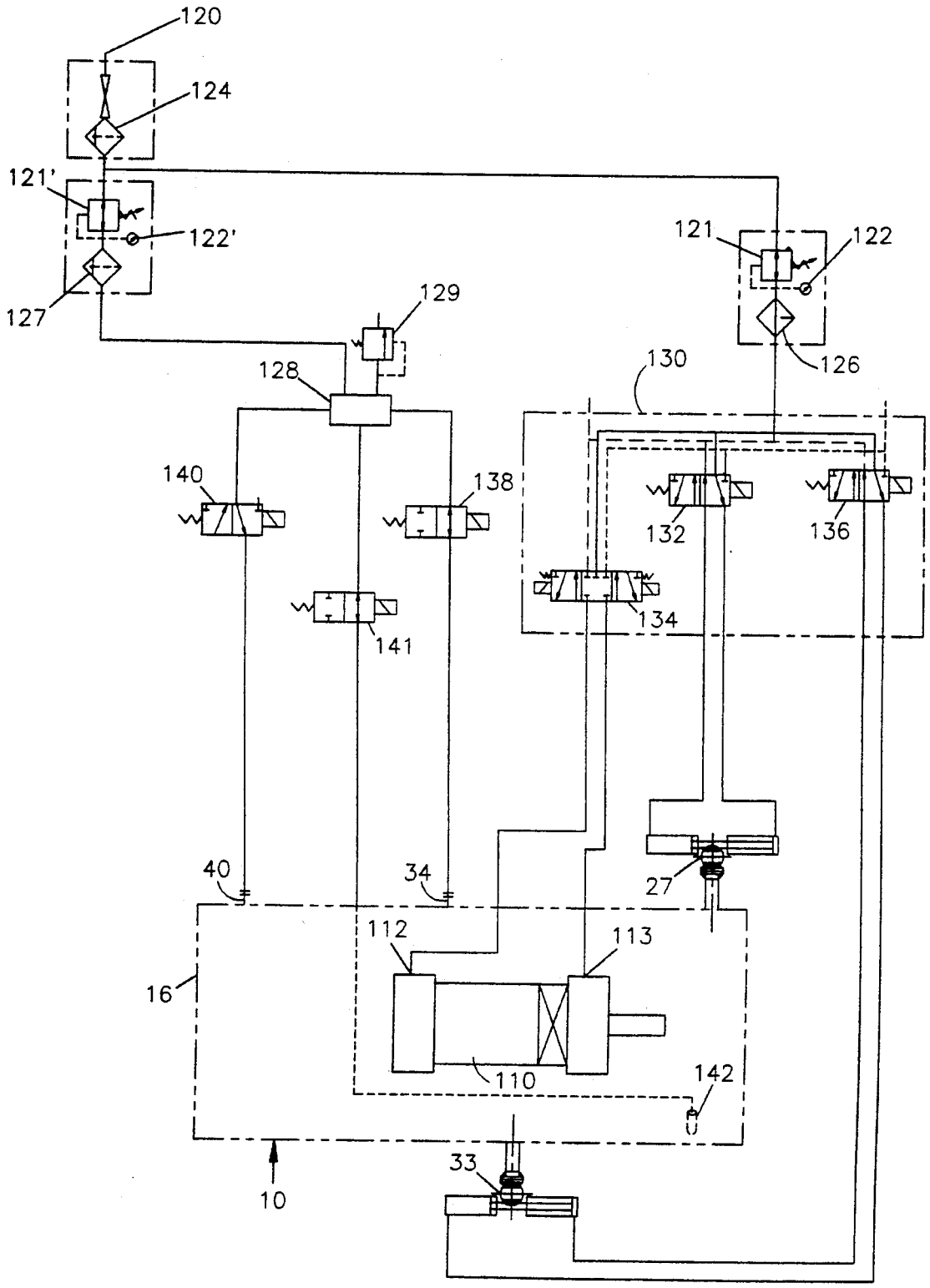
FIG. 10 illustrates the pneumatic system utilized to operate the liquid/solid separator.

A pneumatic pressurized air system, illustrated in FIG. 10, is connected to the liquid/solid separator apparatus in the manner hereafter described.

Stainless steel air supply tubing, which may be one half inch in diameter, connects between a compressed air source 120 and a pressure regulator 121, a pressure gauge 122, a conventional filter 124 and an oiler 126. Branching one-half inch stainless steel tubing leads through a second pressure regulator 121' and a second pressure gauge 122', a coalescing filter 127 and then to manifold 128, equipped with a safety pressure relief valve 129.

A first pressure regulator 121 controls high pressure air, say 80–90 psi to the manifold 130 to control elements external to the liquid/solid separator 10. The second pressure regulator 121' supplies low pressure air, say 20–25 psi, to manifold 128 for operating of the piston 42 within the cylinder 16, for driving the filtered liquid out of the cylinder 16 and for air agitation of the liquid/solids in front of screen-like front wall 44. This agitation serves to circulate and more evenly spread solids over the screen-like front wall 44 as the piston 42 is being moved forward.

The first pressure regulator 121 supplies pressurized air to three integrally manifolded four-way solenoid valves, one such valve being as a liquid inflow ball valve remote operator 132, another such valve serving as a pneumatic door actuator remote operator 134, and another such valve serving as an outflow ball valve remote operator 136. Each remote operator 132, 134, 136 supplies pressurized air through two lengths of stainless steel annealed tubing. All solenoid valves herein described are electrically actuated by a conventional programmable logic controller.

The air supply tubing from the liquid inflow ball valve remote operator 132 connects with the liquid inflow ball valve 27; one length of supply tubing from the pneumatic door actuator remote operator 134 connects with the thrust port 112, the other connects with the retraction port 113; and the air supply tubing from the outflow ball valve remote operator 136 connects with the outflow ball valve 33.

Mounted on manifold 128 are a forward air inlet two-way solenoid valve 138 operatively connecting to the cylinder forward air inlet 34, and a pressure reservoir three-way solenoid valve 140 operatively connecting to the cylinder pressurized air port 40. Both valves 138, 140 are high capacity airflow valves. A tangential air inlet two-way solenoid valve 141 of low flow capacity is operatively connected to tangential airflow port 142. All solenoid valves herein described are mounted on manifold 128 and are electrically actuated by a conventional programmable logic controller.

Operation of the Liquid/Solid Separator

The operation of the liquid/solid separator, hereinafter described, illustrates its use in a frying system. Prior to clarification in the liquid/solid separator 10, and illustrated in FIG. 1, used oil is drawn from a conventional frying vat 150 by a centrifugal pump 151, optionally may pass through a conventional coarse prestrainer to remove any large debris, and is pumped to a conventional centrifugal separator 154 through a tangential upper side inlet 156. That portion of the oil from which solids are thereby separated exits through the centrifugal separator central top outlet 157 and is immediately returned to the frying vat 150. The oil from which solids have been thus separated, settles into the separator collection chamber 158 and settles further through the liquid inflow ball valve 27 into the cylinder 16. At a pre-selected timed interval, a conventional electronic timer causes the liquid inflow ball valve 27 to close and a conventional programmable logic controller to initiate an operational cycle of the liquid/solid separator 10.

During a single cycle the piston 42 occupies four different positions relative to the cylinder 16. The first piston position, illustrated in FIG. 2, is the fully retracted position, in which the forward end of the piston flow slot 65 is in contact with the standpipe stroke-limiting means 67, and the piston is therefore entirely within the cylinder piston-retracted section 30. The second piston position, illustrated in FIG. 3, is a compacting position, in which the piston screen-like front wall 44 is moved partially into the compacting stroke section 24 nearer to the closed cylinder door 22. The third piston position is full forward, illustrated in FIG. 4, in which the piston front wall 44 is advanced beyond the cylinder end 18 and the rearward end of flow slot 65 is in contact with standpipe stroke-limiting means 67; and in the fourth piston position, illustrated in FIG. 5, the closing of the door pushes the piston front wall 44 back into the cylinder flush with the cylinder open end 18, and the piston is entirely within the compacting stroke section 24.

Reference is now made to FIG. 11. When the liquid/solid separator 10 is operated by a timing system, repeated cycles occur, as shown in the operational sequence chart FIG. 11, a single sequence of which is now described.

With the piston 42 in its piston-retracted position in the cylinder piston retracted section 30, as seen in FIG. 2, and the cylinder outflow port 32 is in its closed position, the inflow valve 27 at the liquid inflow means 26 opens to admit liquids and solids into cylinder 10 for a predetermined length of time. The liquids and solids enter into the compacting section 24 between the closed cylinder door 22 and the piston screen-like front wall 44, the pressure relief valve 28 allowing displacement of the air therein.

When the pre-set time has elapsed, the liquid inflow ball valve 27 closes and outflow ball valve 33 opens. The interior of piston 42 is then pressurized when the two-way forward air inlet valve 138 opens to flow air to the cylinder's forward air inlet 34; this drives oil, which has collected in the interior of the piston, out through bottom slot 65 and open cylinder outflow port 32, and back to the frying vat 150. After a timed interval, the forward air inlet valve 138 closes and the cylinder pressure reservoir section 38 is then pressurized when the three-way pressure reservoir air valve 140 opens to the air port 40 nearest to cylinder closed end 20, which applies air pressure behind the piston 42. This pressure drives piston 42 forward into the cylinder compacting stroke section 24 to compact solids. Simultaneously the two-way tangential air inlet valve 141 opens to flow air to tangential airflow inlet 142. Air flowing from tangential airflow inlet 142 agitates the solids to evenly coat filter screen 44 and be compressed between the advancing screen 44 and closed door 22. This compressing action forces the oil through the piston screen-like front wall 44 and into the interior of the piston. At timed intervals, during the compacting stroke of piston 42, forward air inlet valve 138 opens momentarily to force oil back to vat 150 when pressurized air from forward air inlet 34 travels around side wall 64 and through slot 65 into the interior of the piston 42.

In one method of operation, after solids have been compressed and the piston interior has been emptied of oil, the forward air inlet valve 138 and the tangential air inlet valve 141 closes; and pressure reservoir valve 140 is placed in its exhaust position; the outflow port 32 exhausts air from the piston interior and liquid outflow ball valve 33 then closes. At this stage, there is no longer air under pressure in either the pressure reservoir air section 38 or the piston interior, nor any other part of the cylinder.

Air pressure is then supplied through four-way door actuator valve 134 to the pneumatic actuator retraction port 113 which opens the cylinder door 22, as previously described.

Figure 4:
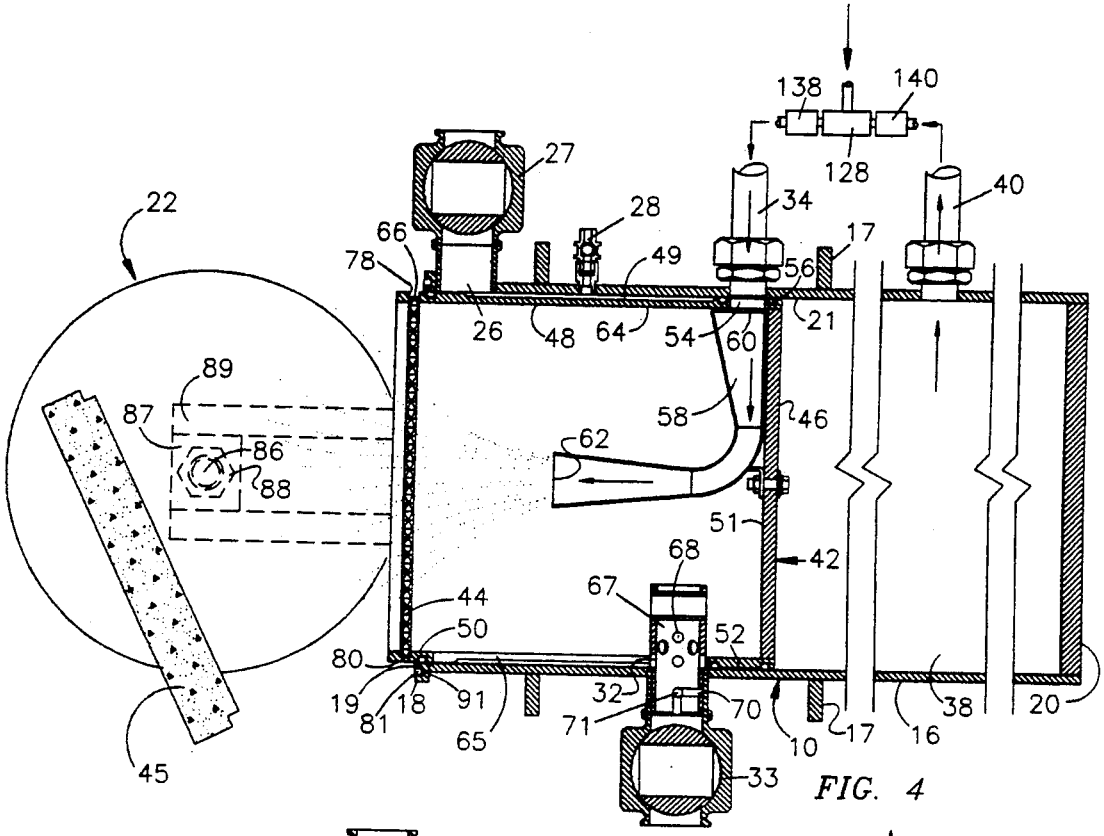
FIG. 4 is a similar cross-sectional view showing the piston in its fullest forward position permitted by opening of the cylinder end door, and illustrates the compressed cake of solid material being blown off the piston screen.
Figure 5:
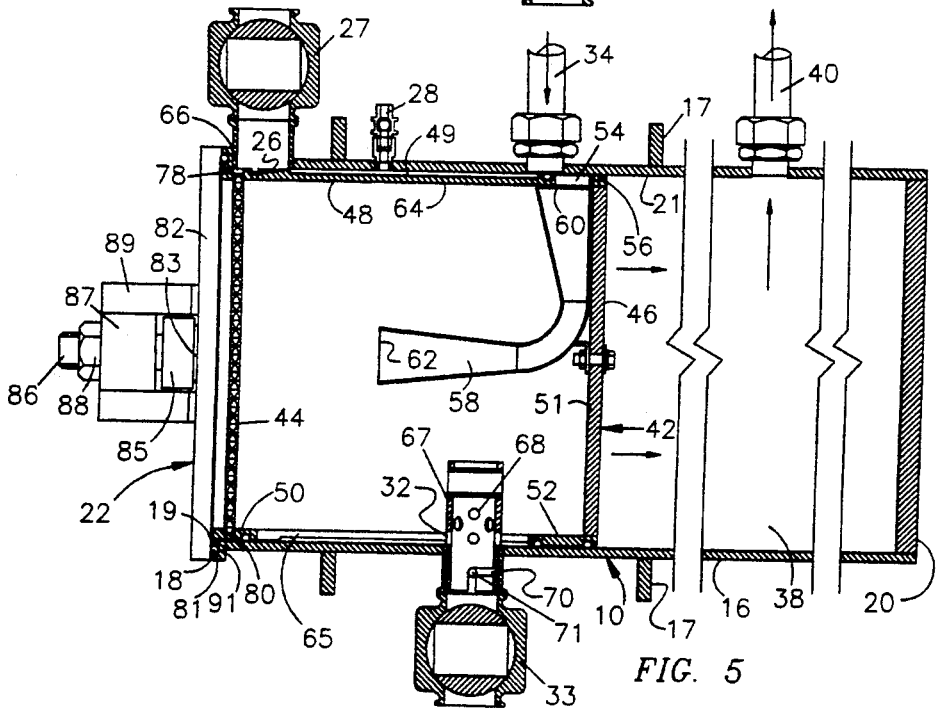
FIG. 5 is a similar cross-section showing the piston driven back flush with the cylinder end by the closing of the door.

The pressure reservoir section 38 is re-pressurized when pressure reservoir valve 140 opens to drive the piston 42 slowly to its full forward position, as shown in FIG. 4, in which the screen-like front wall 44 advances beyond the cylinder open end 18, its forward movement being stopped by bearing contact upon the rearward end of the piston bottom flow slot 65 and the standpipe 67. This position precisely aligns the forward air inlet 34 and the piston side air inlet 54 to allow pressurized air to enter directly into the piston air horn 58 without flowing around the piston side wall 64 and into the piston interior through the piston bottom flow slot 65. Air can then be transferred substantially instantaneously from the pressure reservoir 38, (which serves as a surge tank, through open pressure reservoir valve 140, manifold 128, and open forward air inlet valve 138) to air inlet 54. Such air surges from reservoir 38 through the piston screen 44, to blow off the compacted solid cake 45 and clear the screen 44 of any remaining solid particles.

The full forward piston position shown in FIG. 4 allows removal of the screen 44 from the piston 42 for occasional further cleaning or replacement.

In both the preferred and alternate methods described hereafter, forward air inlet valve 138 and pressure reservoir valve 140 close to stop the airflow through the screen 44, and pressure reservoir 38 returns to atmospheric pressure.

The door actuator valve 134 closes door 22 when pressurized air is supplied to the pneumatic actuator thrust port 112 in the manner previously described and as shown in FIG. 6. The closing of the door 22 pushes the piston 42 back into the cylinder end 18.

Pressurized air is then supplied, when forward air inlet valve 138 opens, to the piston interior, creating pressure against the piston interior rear wall 48 to push the piston 42 as shown in FIG. 2 back to rearward position, with the forward end of the bottom flow slot 65 against the standpipe 67.

Forward air inlet valve 138 closes and the liquid outflow valve 33 opens momentarily to exhaust the air pressure in the piston interior and cylinder compacting section 24.

This operation completes a single cycle of the liquid/-solid separator 10, and now the liquid inflow ball valve 27 opens to begin another cycle. During the time that liquid/solid separator 10 is going through its cycle, the centrifugal separator 154 is continuously separating particulate which is settling in the oil held in the centrifugal separator collection chamber 158. When liquid inflow ball valve 27 opens, the particulate which has settled in centrifugal separator collection chamber 158, flows into the compacting section 24 of cylinder 16. Centrifugal separator collection chamber 158 acts therefore as a surge tank for centrifugal separator 154 when liquid/solid separator 10 is going through its cycle. The result is that the centrifugal separator 154 is always operating.

An alternate method of using the air pressure to clean the screen 44 may be desirable, depending on such variables as the effective mesh size of the screen 44, and the size and nature of the solid particles to be filtered.

This alternate method, rather than exhausting the cylinder before the door is opened, maintains the air pressure in the piston interior and in the pressure reservoir section 38 while the door 22 is opened. In this alternate method, air pressure drives the piston forcefully to its full forward position, and then transfers, substantially simultaneously, air from the pressure reservoir section 38 to the piston interior and piston air horn 58. This expels the air more rapidly through the screen 44, which may, in some circumstances, avoid channeling of the air pressure without cleaning the screen 44.

An alternate method of operating the liquid/solid separator 10, as under conditions where a centrifugal separator 154 and centrifugal separator collection chamber 158 may be dispensed with, is to flow the liquid/solid mixture directly to the open liquid inflow ball valve 27, with the remaining operations procedure as above described. A conventional differential pressure device senses a pre-set back pressure on screen 44, and sends a signal to the programmable logic controller to close liquid inflow ball valve 27 and initiate a cycle of the liquid/solid separator 10.

While the present invention was originated for the specific purpose of clarifying food-frying oil, it is uniquely fitted for other food-processing operations because of its inherent cleanliness of operation. Compressed air, maintained free of contaminants, is the only motive power; it is used both for operating the piston and for returning the oil from the cylinder to the frying vat. Nevertheless, the invention may be utilized effectively for pre-straining of liquids which will subsequently be filtered through a membrane, reclamation of chemical catalysts or reagents suspended in emulsions, and may include processes which do not require sanitary conditions, such as removal of shavings and shards from oil used in machining processes, and separation of waste sludge into its solid and liquid components to allow appropriate disposal of each.

As various modifications may be made in the procedures herein described and illustrated without departing from the scope of the invention, it is intended that all matter contained in the foregoing description or shown in the accompanying drawings shall be taken as illustrative rather than limiting.

I claim:

1. A liquid/solid separator comprising

A. a hollow cylinder having an inner and an outer wall surface and also having an end door, means to open and close said end door and to hold same sealedly closed, means, adjacent to said end door, to introduce into said cylinder liquid in which solids are suspended, which means to introduce may be operable to open or closed positions, and means, farther from said end door, to provide for outflow of filtered liquid from said cylinder, which outflow means may be operable to open or closed positions, in combination with B. a hollow piston fitted within said cylinder, said piston including a screen-like front wall and, spaced therefrom, an imperforate rear wall, and a side wall connecting said front and rear walls, together with means to conduct such liquid out of said piston to said cylinder outflow means, and C. means to so propel said piston that said screen-like front wall travels from a piston-retracted position, in which said screen-like wall is axially between said means to introduce and said means to provide outflow, to a compacting position adjacent to said end door, said imperforate rear wall being aft of said outflow means at both said retracted position and said compacting position, whereby both to screen such liquid through said piston screen-like front wall and allow such screened liquid to pass through said means to provide outflow, and to compact such solids between said cylinder end door and said piston screen-like front wall, further comprising D. means to retract said piston to such piston-retracted position.

2. A liquid/solid separator as defined in claim 1 further includes means, operable when said door is closed and said means to introduce is closed and said outflow means is open, to deliver pressurized air to said cylinder forwardly of said piston rear wall, whereby to deliver liquid out of said cylinder, and means to retract said piston to such piston retracted position after the liquid has been so delivered from said cylinder by such pressurized air.

3. A liquid/solid separator as defined in claim 2, further including means mounted to said cylinder inner wall and interacting slidingly with said piston side wall to limit such travel of said piston forward from its piston-retracted position, and on its return to its piston-retracted position, and means, mounted to said inner wall and interacting with said piston to prevent rotation of said piston.

4. A liquid/solid separator as defined in claim 3 wherein said piston travel limiting means includes a piston wall opening, and a member substantially axially aligned with said outflow means and projecting into said piston wall opening.

5. A liquid/solid separator as defined in claim 3 wherein said piston travel limiting means includes a forward-and-aft slot in said piston wall, and a perforate standpipe projecting inward from said cylinder outflow means and into said piston slot.

6. A liquid/solid separator as defined in claim 1, further including means to provide pressurized air behind said piston screen-like front wall when said door is open, whereby to blow air through said screen when said cylinder end door is open, to clean said screen-like front wall.

7. A liquid/solid separator as defined in claim 1, wherein said means to propel said piston operates, after said end door is open, to farther advance said piston beyond said compacting position to a full forward position at the adjacent end of said cylinder, and in which said screen-like front wall is removably mounted in said piston.

8. A liquid/solid separator as defined in claim 1, wherein said means to propel said piston operates, after said end door is open, to farther advance said piston beyond said compacting position through the adjacent end of said cylinder, and in which said screen-like front wall is removably mounted in said piston.

9. A liquid/solid separator comprising

A. a hollow cylinder having an inner and an outer wall surface and also having a forward end door, and means to open, close, and hold said door sealedly closed, said cylinder being characterized in having (i) a compacting stroke section immediately aft of said cylinder end door, said compacting stroke section having liquid inflow means, adjacent to said end door, to introduce liquid in which solids are suspended, and a pressure relief valve, mounted to penetrate the wall of such cylinder adjacent to said liquid inflow means, for protection of such separator against harm by excessive pressure in said cylinder, (ii) a piston-retracted section axially adjacent to said compacting stroke section, said piston-retracted section having an outflow port for filtered liquid, and a cylinder forward air inlet for pressurized air, and (iii) a pressure reservoir section, axially adjacent to said piston-retracted section, having a port for airflow, said section terminating in a cylinder closed end, B. a hollow piston fitted slidably within said cylinder, said piston including means limit said piston movement as between said piston-retracted section and a full forward position at the forward end of said cylinder, a screen-like front wall, whereby liquid may flow therethrough into said piston, an imperforate rear wall, means to permit liquid flow from the interior of said piston to said cylinder outflow port for filtered liquid, and means to permit flow of pressurized air into said piston from said cylinder forward air inlet, whereby such pressurized air may force liquid out of said piston and cylinder through the cylinder outflow port, clean the piston screen-like front wall when the end door is open, and retract the piston when the end door is closed.

10. A liquid/solid separator as defined in claim 9, further including a tangential air inlet into said cylinder inwardly adjacent to said door, whereby introduction of pressurized air through said inlet agitates such solids so that such solids remain dispersed in such liquid during the compression of said piston.

11. A liquid/solid separator as defined in claim 9 wherein said means to permit flow of pressurized air into said piston from said cylinder forward air inlet includes an airhorn by which pressurized air is delivered toward and distributed over said screen-like front wall during such cleaning.

12. A liquid/solid separator as defined in claim 9, said piston having fore-and-aft circumferential sealing portions, whereby to provide sliding contact with said cylinder inner wall, a smaller diameter cylindrical sidewall therebetween and communicating with the interior of the piston, whereby to conduct pressurized air from said cylinder forward air inlet to the interior of said piston during piston travel, and an air inlet in said aft circumferential sealing portion forwardly adjacent to said piston rear wall, whereby to register with said cylinder forward air inlet and permit pressurized air flow into said piston when said piston is in its full-forward position at the forward end of said cylinder.

13. A liquid/solid separator as defined in claim 12, together with a forward-and-aft slot in said piston side wall smaller diameter, whereby to provide such communication with the interior of the piston.

14. A liquid/solid separator as defined in claim 9, together with means to communicate pressurized air to said cylinder forward air inlet from said cylinder pressure reservoir section.

15. The invention comprising a hollow cylinder having an axis, inner and outer surfaces of the cylindrical wall which terminate at an open forward end, and an end door for said cylinder open end presentable closingly thereagainst, said door having an inner side closeable against said open forward end and an outer side, and having on said outer side a mount for supporting said door, in combination with mechanism for presenting said door sealedly against the cylinder end and removing it outward and sideward therefrom, said mechanism including A. bracket means outstanding from the outer surface of the cylindrical wall of said cylinder spacedly adjacent to its open end, said bracket means having a nearer pivot point and a farther pivot point, B. a bell crank having (i) a first arm portion pivotally connected to said bracket nearer pivot point and turnable thereabout from a door-open position, in which said first arm portion extends at an angle substantially perpendicular to and away from the cylinder axis, to a closed door position at which said first arm portion extends forwardly and substantially parallel to the cylinder axis, (ii) said first arm portion terminating in a bell crank center pivot point, which propelled by the aforesaid turning of said first arm portion, travels to a door-closing position forward and sideward of said cylinder forward end, said bell crank further having (iii) a second arm portion extending from said bell crank center pivot point substantially at a right angle to said first arm portion and for a length substantially equal to the distance from said bracket nearer pivot point to the axis of the cylinder, said second arm portion terminating in a mount on which said door is mounted, in combination with C. first and second actuator links having adjacent ends pivot-connected to each other, the opposite end of said first link being pivot-mounted onto the bracket farther pivot point and the opposite end of said second link being pivot-connected to said bell crank center pivot point, said links being of such combined length as, on being aligned substantially linearly with each other, to cause said bell crank center pivot point to travel at least to said door closing position, and D. a powered reversible linear actuator so mounted at the pivot-connection of said actuator links, whereby when said actuator is so powered as to retract, to withdraw said links from such aligned position, and to rotate said bell crank about the bracket near pivot point and cause said center pivot point of said bell crank to travel away from said door-closing position, thereby opening said door outward from said sideward of said cylinder end, and whereby, when said actuator is so powered as to extend, to close the door and maintain it closed by such substantial linear alignment of said actuator links.

16. Apparatus for delivering liquid containing solid particles from a vat, separating from the liquid such solid particles, and returning such liquid so clarified to such vat, comprising I. liquid solid separator comprising A. a hollow cylinder having an open forward end closable by a door said hollow cylinder being characterized in having (i) a compacting stroke section immediately aft of said cylinder end door, said compacting stroke section having liquid inflow means, adjacent to said end door, to introduce at intervals liquid in which solids are suspended, (ii) a piston-retracted section axially adjacent to said compacting stroke section, said piston-retracted section having an outflow port for filtered liquid, further having a cylinder forward air inlet for pressurized air, and (iii) a pressure reservoir section, axially adjacent to said piston-retracted section, having a port for pressurized air, said section terminating in a cylinder closed end, together with B. a hollow piston fitted slidably within said cylinder, said piston including means to limit said piston movement as between said piston-retracted section and a full-forward position at the forward end of said cylinder, and means to prevent piston rotation, a screen-like front wall, whereby liquid may flow therethrough into said piston, an imperforate rear wall, means to permit liquid flow from the interior of said piston to said cylinder outflow port for filtered liquid, and means to permit flow of pressurized air into said piston from said cylinder forward air inlet, whereby such pressurized air may force liquid out of said piston and cylinder through the cylinder outflow port, clean the piston screen-like front wall when the end door is open, and retract the piston when the end door is closed, II. a mechanism, mounting said door by said mounting point, for presenting said door sealedly against the cylinder end and removing it outward and sideward therefrom, said mechanism including A. bracket means rigidly outstanding from the outer wall of said cylinder spacedly adjacent to its open end, said bracket means having a nearer pivot point and a farther pivot point, B. a right angle bell crank having (i) a first arm portion pivotally connected to the said bracket nearer pivot point and turnable thereabout from a door-open position in which said first arm portion extends at an angle substantially perpendicular to and away from the longitudinal axis of said cylinder to a closed door position at which said first arm portion extends forwardly and substantially parallel to the cylinder axis, (ii) said first arm portion terminating in a bell crank center pivot point, which propelled by the aforesaid turning of said first arm portion, travels to a door-closing position forward and sideward of said cylinder forward end, said right angle bell crank further having (iii) a second arm portion extending from said bell crank center pivot point substantially at a right angle to said first arm portion and for a length substantially equal to the distance from said bracket nearer pivot point to the axis of the cylinder, said second arm portion terminating in a mount on which said door is mounted, in combination with C. first and second dead center links having adjacent ends pivot-connected to each other, the opposite end of said first link being pivot-mounted onto the bracket farther pivot point and the opposite end of said second link being pivot-connected to said right-angle bell crank center pivot point, said dead center links being of such combined length as, on being aligned linearly with each other, to cause said right angle bell crank center pivot point to travel to said door-closing position, and D. a powered reversible linear actuator so mounted at the pivot-connection of said dead center links as, when powered, to withdraw said links from linear alignment, in further combination with III. centrifugal pumping means to deliver liquid from such vat to said cylinder liquid inflow means, in further combination with IV. a source of air pressure to said cylinder forward air inlet, whereby to drive such liquid so clarified, from the separator to the holding vat.

17. Apparatus for delivering liquid containing solid particles from a vat, separating from the liquid such solid particles, and returning such liquid so clarified to the vat, comprising a liquid/solid separator for clarifying such liquid, said separator comprising a cylinder having an openable end door, further having means to admit liquid containing such particles at intervals when said door is closed and such liquid is pumped to said means to admit, and piston-like means powered by air pressure to drive a screen through such liquid, thereby to filter such liquid and pass it to the side of said screen opposite said means to admit, and to compact such solid particles, and air pressure means to drive such liquid, so filtered from the screen opposite side back to such vat, together with means to open and close said door, and air pressure means to discharge such compacted solids from said door when open.

* * * * *

UNITED STATES PATENT AND TRADEMARK OFFICE

CERTIFICATE OF CORRECTION

PATENT NO. : 5,277,109

DATED : January 11, 1994

INVENTOR(S) : Sanitary Liquid/Solid Separator

It is certified that error appears in the above-identified patent and that said Letters Patent is hereby corrected as shown below:

Column 10, line 40, after "means" insert ---to---.

Column 12, line 16, delete "said" and insert ---and---.

Signed and Sealed this

Seventeenth Day of May, 1994

Bruce Lehman

*Attest:*

BRUCE LEHMAN

*Attesting Officer*

*Commissioner of Patents and Trademarks*